United States Patent [19]

Gagnon et al.

[11] 3,979,091

[45] Sept. 7, 1976

[54] COMMUNICATION SYSTEM FOR GUIDEWAY OPERATED VEHICLES

[75] Inventors: Forrest W. Gagnon, Littleton; Arthur H. Marsh, Arvada, both of Colo.

[73] Assignee: Otis Elevator Company, New York, N.Y.

[22] Filed: June 6, 1975

[21] Appl. No.: 584,669

Related U.S. Application Data

[63] Continuation of Ser. No. 389,766, Aug. 20, 1973, abandoned.

[52] U.S. Cl. ..... 246/8; 246/63 C; 246/122 R; 246/187 B; 343/711

[51] Int. Cl.[2] ..... B61L 1/08

[58] Field of Search ..... 246/8, 30, 63 R, 63 C, 246/122 R, 182 B, 187 B; 179/82; 325/51, 53, ; 343/711, 713, 719; 340/23, 38 L; 333/84 L

[56] References Cited

UNITED STATES PATENTS

| | | | |
|---|---|---|---|
| 3,327,111 | 6/1967 | Frech | 246/122 R |
| 3,527,897 | 9/1970 | Sugi | 246/8 |
| 3,772,640 | 11/1973 | Aver | 246/63 C |

FOREIGN PATENTS OR APPLICATIONS

| | | | |
|---|---|---|---|
| 1,219,425 | 1/1971 | United Kingdom | 246/8 |

*Primary Examiner*—Stephen G. Kunin
*Assistant Examiner*—Reinhard J. Eisenzopf
*Attorney, Agent, or Firm*—Robert T. Mayer

[57] ABSTRACT

A communication system for track or guideway operated vehicles is disclosed. The system is adapted for two-way transmission between a vehicle and a wayside station and is provided with a transmission line of special configuration along the wayside. The transmission line comprises three conductors each having a wave configuration with the waves disposed in three-phase relationship and a return conductor which is also of wave configuration. The vehicle transmitter section is provided with an inductive loop which is coupled with the transmission line and is energized with a continuous wave signal. This produces signals on the three phase conductors which have an envelope frequency proportional to vehicle speed and a phase relationship corresponding to the relative position of the wave configurations of the phase conductors. Thus, vehicle speed may be derived by measuring frequency and vehicle position may be derived by counting cycles or pulses from a given starting point. Direction of the vehicle travel can be derived from the phase sequence of the signals in the phase conductors. At the base station, the receiver section is provided with means for squaring each of the phase signals and summing the squared signals to develop a continuous signal, i.e. one which has an amplitude independent of the position of the transmitting loop along the transmission line. The two way voice communication channel and a two way data communication channel is also provided utilizing the above mentioned transmission line. The transmission line configuration and the configuration of the transmitting and receiving loops are such that the system is immune to far field radiation.

23 Claims, 10 Drawing Figures

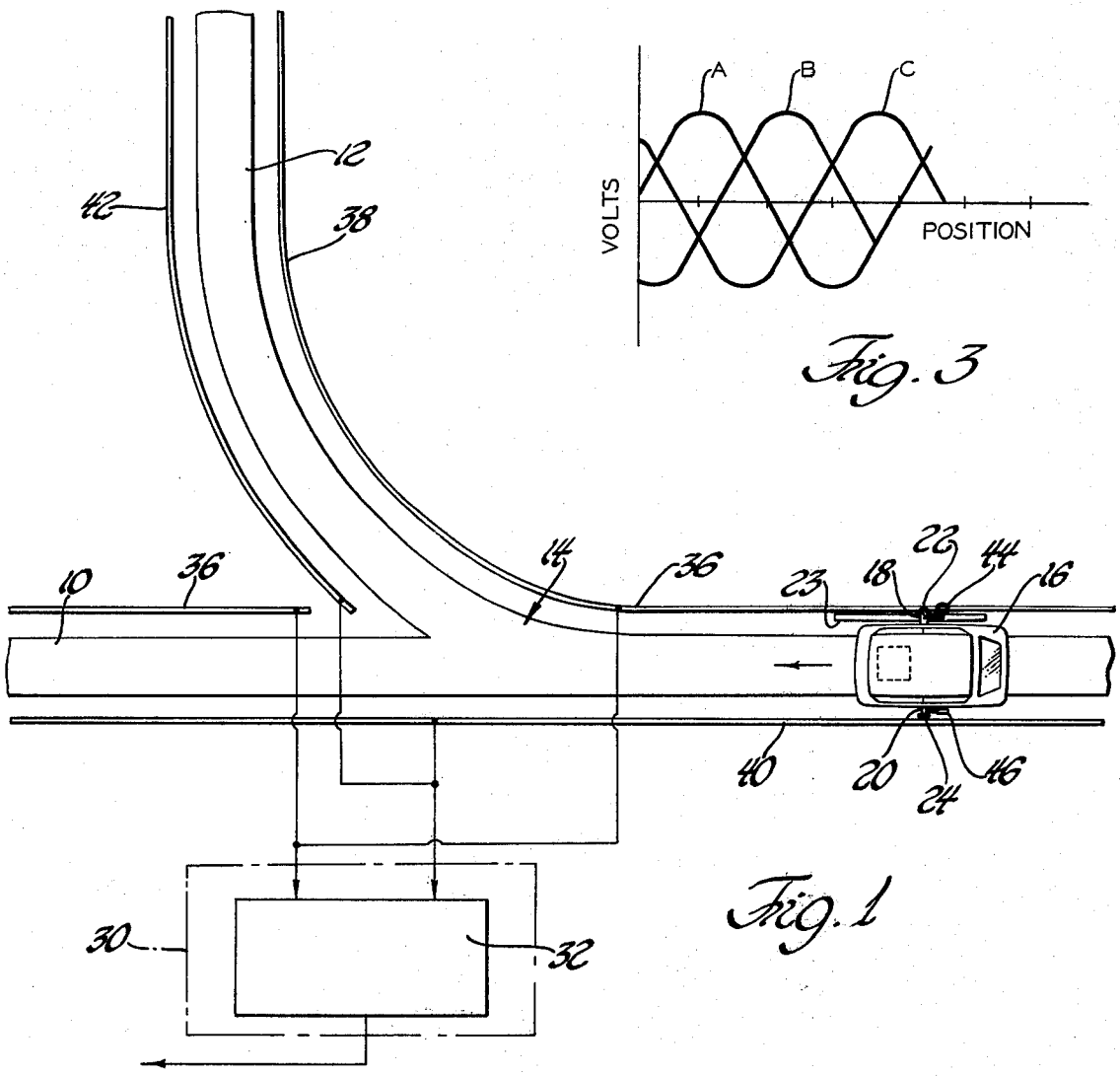
Fig. 3
Fig. 1
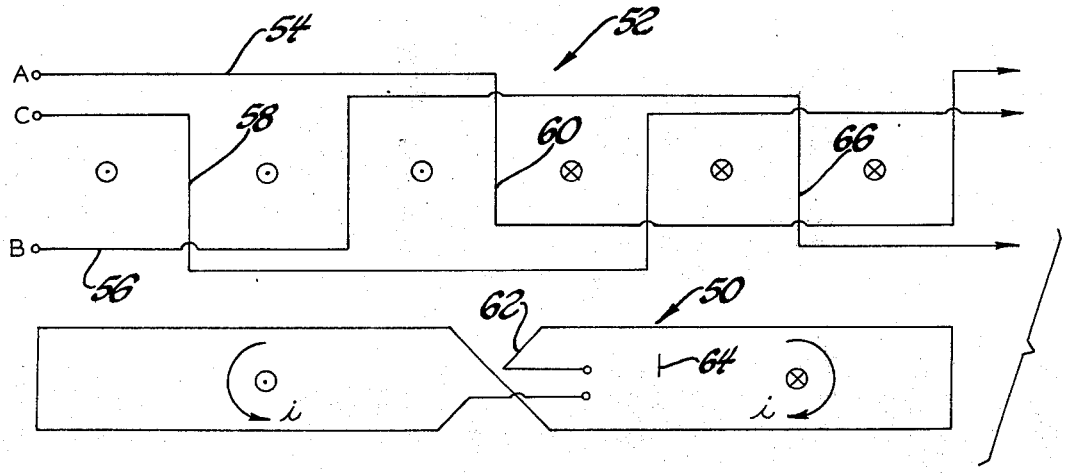
Fig. 2

COMMUNICATION SYSTEM FOR GUIDEWAY OPERATED VEHICLES

This is a continuation of application Ser. No. 389,766 filed Aug. 20, 1973, now abandoned.

This invention relates to communication systems for track or guideway operated vehicles and more particularly to an improved transmission line and coupling arrangement for such systems.

In the prior art, many different communication systems have been proposed and, in some cases, actually put into use. However, the advanced technology in transportation systems especially high-speed and automatically controlled transit systems now being built impose heavy demands in regard to capacity and reliability of the communication system. In a given system, for example, a personal rapid transit system, a single vehicle may require communication of safety system information, as well as vehicle operation and control data and voice communication with a wayside or local controller station.

In the prior art, radio frequency transmission systems have been proposed for such vehicle communication. However, RF transmission requires governmental licensing because of field radiation and hence the frequency allocation available is severely restricted. A distinct disadvantage of such RF systems is that safety system information relating to vehicle position, speed, etc. is not available without active information generation and transmission from the vehicle. Further, direct air-wave links are ineffective when the vehicle route passes between buildings or through tunnels. Such systems are also susceptible to interference from far field radiation transmitters such as radio and TV stations.

The prior art also includes communication systems of the inductive loop type but such systems also exhibit severe disadvantages. The bandwidth is very limited with no high frequency capability. Further, there is no far field radiation immunity or cancellation. The conventional inductive loop systems utilize two-wire transmission line with parallel conductors together with an inductive loop mounted on the moving vehicle. It has been proposed to reduce interference produced in the two-wire transmission line by providing transpositions therein, i.e. with crossovers at regular intervals. The difficulty with such a transposed two-wire line, however, is that the signal coupled between an inductive loop on a moving vehicle and the line will be interrupted at the crossovers. It has been proposed to avoid this difficulty in the prior art by providing a pair of two-wire transmission lines each having spaced crossovers and with the crossovers occurring alternately. The pair of two-wire lines are excited with phase displaced equal amplitude signals so that the signal received from the transmission line will always be greater than zero. Such an inductive loop system is shown in U.S. Pat. No. 3,527,897. Other inductive loop systems for vehicles are shown in U.S. Pat. No. 3,617,890 and U.S. Pat. No. 3,694,751.

SUMMARY OF THE INVENTION

In accordance with this invention, a communication system is provided which utilizes advantageous features of an inductive loop system and which also provides a good bandwidth and exhibits great immunity to far field radiation and produces negligible radiation into the far field. This is accomplished by use of a balanced transmission line with at least three conductors, each having a wave configuration and with the waves of the conductors offset relative to each other so that the wave configurations of the conductors form a pattern like that of the conventional representation of polyphase voltages, each conductor corresponding to each phase voltage in said conventional representation. Additionally, means are provided to prevent reflection of signal waves from the far end of the transmission line and this preferably takes the form of a fourth conductor as a return path for the signal currents. The transmission line coacts with an inductive transmitter loop on the vehicle so that the signals induced in each of the phase conductors of the transmission line are of equal amplitude but are phase displaced from each other. Accordingly, vehicle speed, position and direction information may be readily derived by measurement at the wayside station of the frequency, number of cycles or pulses and phase sequence of the signal on the phase conductors. The transmission line conductors and the transmitting and receiving inductive loops of the system are configured in such a manner that they produce no far field radiation and they are immune to interference from far field radiation transmitters.

Further, in accordance with this invention voice and data communication channels may be provided over the aforementioned transmission line which in conjunction with the receiver circuits produces a continuous signal, i.e. one which has an amplitude independent of the position of the loop along the transmission line. In particular this is accomplished at the wayside station by squaring each of the signals on the separate phase conductors of the transmission line and then summing the squared signals to obtain the continuous signal for use in the detection stages of the receiver. At the vehicle receiver a pair of receiving loops are employed which are phase displaced along the transmission line in such a manner that a continuous signal is developed by squaring each of the receiver loop signals and summing the squared signals for use in the detection stages of the receiver.

Further, in accordance with the invention, the transmitting loop and the receiving loop on the vehicle are rendered immune to far field radiation by forming each loop into a figure-eight configuration. To minimize the transmitted signal picked up by the two receiving loops, one receiving loop is placed within one lobe of the figure-eight transmitting loop and the other receiving loop is placed within the other lobe of the figure-eight transmitting loop.

Additionally, the invention provides a communications transmission line of a three-phase, four wire configuration having distributed capacitance and wide bandwidth and a characteristic impedance which is independent of its environment. This is accomplished by disposing the conductors of the transmission line between insulator ribbons and laminating the ribbons to form a unitary cable.

A more complete understanding of the invention may be obtained from the detailed description that follows taken with the accompanying drawings in which:

FIG. 1 is a diagram of a typical application of the invention in a vehicle communication system;

FIG. 2 depicts a three-phase transmission line and a vehicle transmitting loop;

FIG. 3 shows the phase relation of voltages on the conductors of the transmission line;

FIG. 9 is a block diagram of the base station; and

PART I — SYSTEM ARRANGEMENT

Figure 5:
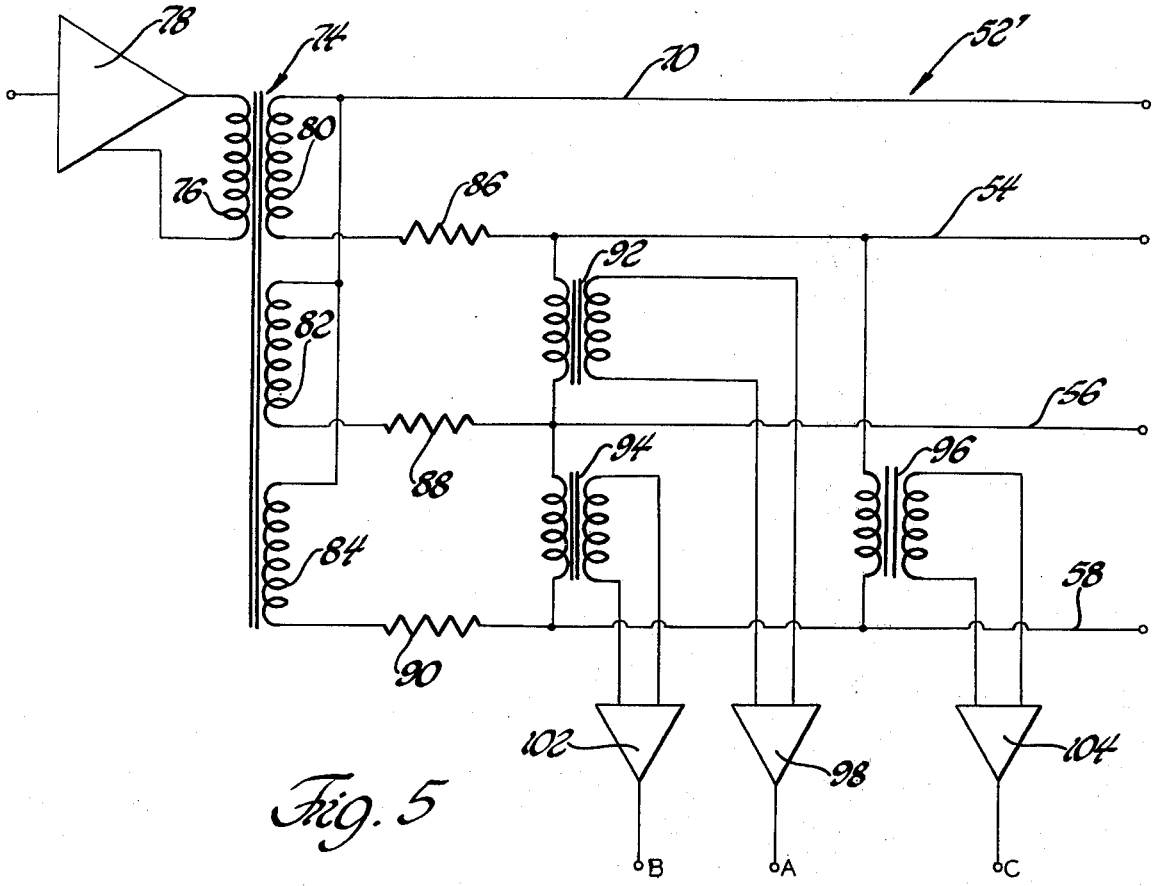
FIG. 5 shows the interface circuitry between a base station and the transmission line.

Referring now to the drawings there is shown an illustrative embodiment of the invention in a communication system for a guideway or track operated vehicle adapted for transporting personnel or cargo. In particular, the guideway operated vehicle in the illustrative embodiment is of the type set forth in copending application Ser. No. 245,414 for "Transportation System and Vehicle Therefor" filed Apr. 19, 1972, now U.S. Pat. No. 3,793,963, and assigned to the same assignee as this application. The guideway operated vehicle is provided with running gear of the air cushion type and utilizes a linear induction motor for propulsion purposes. It will be apparent as the description proceeds that this invention is not limited in its application to such a vehicle and guideway system; instead it is of general application for communication and control purposes for a vehicle traveling along pre-established pathways.

As illustrated in FIG. 1, a typical transportation system in which the subject invention is employed comprises a main guideway 10 and a branch guideway 12 connected with the main guideway at a junction 14. A vehicle 16 is movable along the guideway at a controlled speed and with guideway switching capability to selectively remain on the main guideway 10 or switch to the branch guideway 12. For guideway switching purposes the vehicle is provided with a right-side retention arm 18 which is shown in the extended position. The vehicle is also provided with a left-side retention arm 20 which is shown in the retracted position. The retention arm 18 carries a switching wheel 22 which in its extended position engages a switching rail 23 to retain the vehicle in the pathway along the right side of the guideway through the junction 14. The left-side retention arm 20 carries a wheel 24 which in the retracted position is disengaged from the left-side switching rail and therefore is ineffective to retain the vehicle along the path of the left side of the guideway through the junction 14. The switching arrangement together with the construction and operation of the retention arms are fully disclosed in the aforementioned patent application Ser. No. 245,414. A wayside station 30 is located along the main guideway 10.

As further illustrated in FIG. 1 the vehicle communications system comprises a base station or local controller 32 suitably located at the wayside station 30 and a mobile or vehicle station 34 in the vehicle 16. The communication link between the base station and the vehicle station comprises an antenna system which includes a transmission line 36 on the right side of the main guideway 10 and a transmission line 38 on the right side of the branch guideway 12. In a similar manner, a transmission line 40 is disposed on the left side of the main guideway 10 and a transmission line 42 is disposed on the left side of the branch guideway 12. As will be described in more detail later, the vehicle is provided with transmit-receive loops 44 mounted on the retention arm 18 for inductive coupling with the transmission lines 36 and 38 when the retention arm 18 is extended. Similarly the vehicle is provided with transmit-receive loops 46 mounted on the retention arm 20 for coupling with the transmission lines 40 and 42 when the arm 20 is extended. When either arm is in its retracted position the respective transmit-receive coupling loops are remote from the respective transmission lines and the loops are effectively disconnected from the system.

The vehicle communications system of this invention is adapted to provide two-way transmission between the vehicle and the wayside station. In particular, the system is adapted for communication of three different types of information, namely, safety system information, operation and control data for the vehicle and voice communication. The safety system information relates uniquely to a given vehicle and is transmitted from the vehicle over the transmission line by an unmodulated CW (continuous wave) signal. The safety system information includes position, speed, direction, and retention arm position for the vehicle. The vehicle control and operation data is adapted to exercise control over the vehicle movements and is transmitted by narrow band, phase modulated, time multiplexed channels. The voice communication is also provided by narrow band, phase modulated channels but is not time multiplexed so that any vehicle on the guideway section can receive the controller voice channel but only one vehicle at a time can talk to the controller.

While this invention is concerned primarily with the communication of the so-called safety system information, i.e. position, speed, direction and retention arm position, the transmission line and coupling loops therefor not only are highly successful in fulfilling that requirement but also are highly successful for the other types of communication, namely, phase-modulated data channels and phase-modulated voice channels.

PART II — VEHICLE TRANSMITTER COUPLING WITH TRANSMISSION LINE

In accordance with this invention each transmission line, such as transmission lines 36, 38 and 40, comprises plural conductors arranged in a polyphase distribution. In particular, the transmission line comprises four conductors of which three are arranged in a three-phase space distribution and a fourth conductor serves as a return path for the currents in the other conductors. The transmission line is balanced, i.e. each of the three-phase conductors carries equal currents which are in phase with each other. The conductors of the transmission line are spaced sufficiently in the three-phase distribution and are provided with sufficient distributed capacitance so that the resulting line is balanced with a controlled impedance independent of frequency and hence with a very wide bandwidth. As will be described subsequently, coupling into and out of the line at the vehicle station is accomplished by inductive loops.

Before discussion of the four-conductor, three-phase transmission line it will be helpful to consider a three-conductor three-phase line as illustrated in FIG. 2. In FIG. 2 a transmitting loop 50 is shown side by side with a three-conductor three-phase transmission line 52. The transmission line 52 comprises conductors 54, 56 and 58 which constitute phases A, B, and C respectively of the transmission line. Each of the conductors 54, 56 and 58 is arranged in a "rectangular wave" configuration with the length of each wave being the same for all conductors. The conductor 54 of phase A is shown throughout one full wave or cycle which may be regarded as corresponding to 360 electrical degrees and which may be of physical dimension (in the illustrative embodiment) on the order of 150 cm. The conductor 56 of phase B is disposed along the length of the transmission line so that the rectangular wave thereof is off-set to the right by a distance corresponding to 120 electrical degrees relative to phase A. Conductor 58 of phase C is disposed along the length of the transmission line with the rectangular wave thereof off-set to the right a distance corresponding to 120 electrical degrees relative to phase B. The horizontal portions of each of the rectangular waves, as shown in FIG. 2, may overlie each other but of course each conductor is insulated from the other. The vertical portions of the rectangular waves in the transmission line, i.e. the crossovers of the conductors, are spaced at a distance corresponding to 60 electrical degrees along the line.

This construction of the transmission line provides for a desired amount of lateral spacing of the conductors and for a desired amount of distributed capacitance between the conductors in the overlying portion so that the transmission line will have an impedance substantially independent of frequency. Furthermore, the transmission line lends itself admirably for the communication of position, speed, and direction information from a moving vehicle through an inductive coupling loop on the vehicle. This attribute of the transmission line will become apparent from a consideration of the voltages induced in the separate phases by a coupling loop which is energized with a CW transmitter signal.

Figure 8:
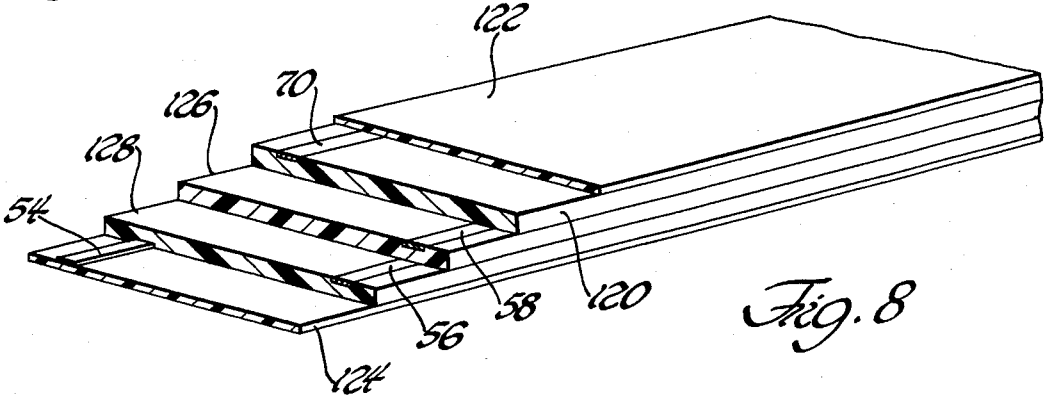
FIG. 8 shows the transmission line construction.
Figure 6:
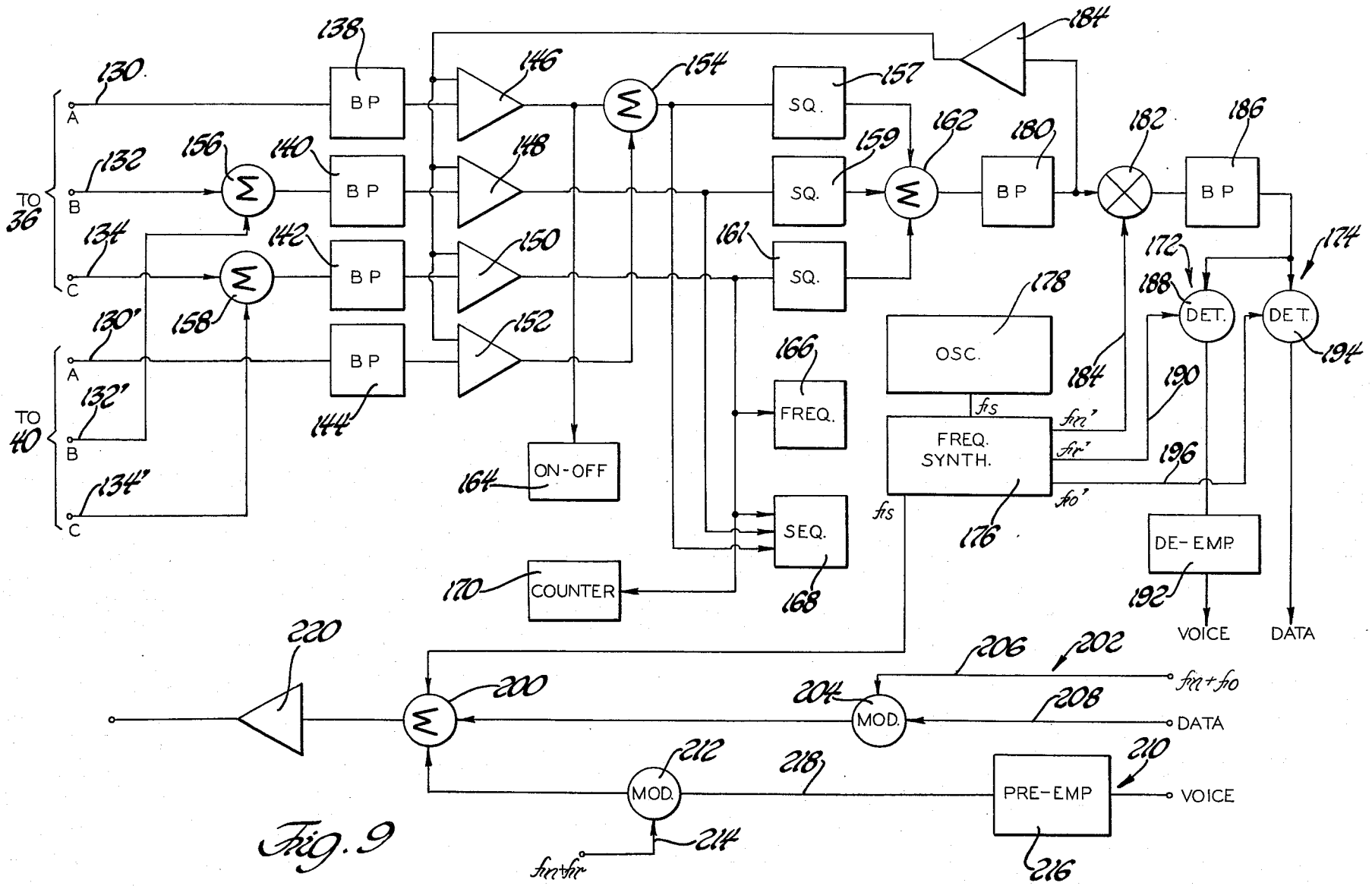

As shown in FIG. 2, the transmitting loop 50 is of figure 8 configuration, i.e., two adjacent loops with a crossover 62. The transmitting loop 50 has a length equal to or somewhat less than a full cycle length of the square wave configuration of the conductors 54, 56 and 58 of the transmission line. Thus, as illustrated in FIG. 2, the transmitting loop 50 is coextensive with the full cycle of the rectangular wave of conductor 54 and the crossover 60 in conductor 54 is aligned with the crossover 62 in the transmitting loop. Although the transmitting loop and transmission line are shown side by side for convenience in FIG. 2, in practice the transmitting loop would be disposed over the transmission line in face to face relationship.

With the transmitting loop 50 energized from a CW source 64, inductive coupling between the transmitting loop and the transmission line conductors is achieved by the magnetic flux field generated by the circulating current around the loop. At a given time, the circulating current in the transmitting loop will have the direction indicated by the arrows in FIG. 2. Consequently, the direction of the resulting magnetic flux field will be as indicated, i.e. coming out of the paper on the left hand side of the loop (represented by the circle-enclosed dot symbol) and going into the paper on the right hand side of the loop (as represented by the circle-enclosed X symbol). At this same instant of time, the magnetic flux will link the conductors 54, 56 and 58 with a flux field direction as indicated by the direction symbols in FIG. 2. It can be seen in FIG. 2 that the transmitting loop is in a position relative to the conductor 54 of phase A to provide the maximum coupling. In considering the degree of coupling it is noted that the voltage induced in the conductor 54 by the left hand side of the transmitting loop is additive with the voltage induced in the conductor 54 by the right hand side of the transmitting loop because of the difference in flux field direction on the two sides of the transmitting loop and the crossover 60 in the conductor 54. With the transmitting loop in the position shown, the coupling with, and the voltage induced into, the conductor 54 of phase A is at its maximum value. In this same position the coupling with, and the voltage induced into, the conductors 56 and 58 of phases B and C respectively are at values less than maximum; in fact, it can be found by inspection that the degree of coupling with conductors 56 and 58 is one third that of the coupling with conductor 54 and it is in the opposite sense. Accordingly, the envelope of the voltage induced in conductors 56 and 58 in this position of the transmitting loop is approximately one third the magnitude of the envelope of the voltage induced in the conductor 54 and is of the opposite polarity. Thus it is seen that the amplitude and polarity of the envelope of the voltage induced by the transmitting loop into the respective transmission line conductors 54, 56 and 58 is a function of the position of the transmitting loop along the transmission line. If the transmitting loop is moved from the position shown in FIG. 2 by a distance equal to 120 electrical degrees so that the crossover 62 of the loop is aligned with the crossover 66 of conductor 56 of phase B, the coupling and hence the envelope of the induced voltage will be maximized in phase B. Similarly, if the transmitting loop is moved further to the right an additional distance equal to 120 electrical degrees the envelope of the voltage induced in the conductor 58 of phase C will be maximized.

From the above discussion it will be apparent that the coupling between the transmitting loop and the transmission line of FIG. 2 will induce voltages in the separate phase conductors 54, 56 and 58 the envelopes of which vary as the function of position along the line. This is depicted in FIG. 3 which shows the voltage variation with position for the envelopes of the voltages of each of the phases A, B and C. The envelope of the voltage in conductor 54 of phase A varies in an approximately sinusoidal manner as a function of position of the transmitting loop. The envelopes of the voltages in conductors 56 and 58 of phases B and C respectively vary in the same manner but the voltages are 120 electrical degrees out of phase with each other because of the 120 degree offset in the rectangular wave configuration of the conductors in the transmission line.

Thus, it is apparent that with the transmitting loop being carried by the vehicle and coupled into the wayside transmission line the frequency of the envelope of the voltage in each of the conductors 54, 56 and 58 will be proportional to the speed of the vehicle. Thus, speed can be measured readily at the base station by measuring the frequency of the envelope of the voltage on any one of the phase conductors. It will also be appreciated that the position of a vehicle may readily be determined by counting the cycles of the envelope of the induced voltage in any one of the conductors of the transmission line beginning with a known starting position. Alternatively, to obtain greater position accuracy the successive peaks of the envelopes of the three-phase voltages may be detected and counted successively so that distance may be determined to an accuracy corresponding to the distance between peaks. Additionally the three-phase transmission line permits determination at the base station of the direction of travel of the vehicle. This is readily determined by measuring the phase sequence of the envelopes of the three separate phase voltages in the conductors 54, 56 and 58 so that the phase sequence of ABC is indicative of one direction of travel whereas a phase sequence of CBA is indicative of the other direction of travel.

In accordance with the invention the communications system exhibits negligible radiation, i.e. no signal is transmitted into the far field and hence no signal can be received from the far field. This, of course, renders the system immune to transmission from far field generators such as radio and TV stations and at the same time it produces no interference with radio receiving stations outside the system. The transmission loop 50 shown in FIG. 2 is of figure 8 configuration formed of two equal size loops with a crossover therebetween. Hence the loop will not radiate into the far field.

The transmission line 52 as shown in FIG. 2, because of its square wave or loop configuration of each conductor, will produce a negligible radiated power. For each conductor the current in contiguous half wave sections will produce fields of opposite polarization but of equal intensity. Accordingly, it can be shown by integration of field intensity over the length of the conductor for any practical length of transmission line that the far field radiating power is zero. Since the far field strength for each conductor approaches zero, the summation of the field strengths for the several conductors in the transmission line will also approach zero and hence the far field radiating power is negligible. Since the transmission line will not radiate into the far field it follows that no signal can be received on the transmission line from far field radiation.

Also, in accordance with the invention, the system provides a continuous communication link in the sense that a signal is derived which is of constant value with respect to the position of the transmitting loop along the transmission line. This property of the communication system is achieved by squaring the voltages between the separate phase conductors and then taking the summation of the squared voltages as the communications signal. This relationship will be appreciated from the following consideration. With a modulated transmitter output signal applied to the transmitter loop of FIG. 2, the voltage induced between any two phase conductors in the transmission line may be considered to be a cosine function of the position of the loop along the transmission line. Consequently each of these voltages will vary in accordance with the position of the loop along the transmission line. As will be apparent, the manner by which the system utilizes these position dependent voltages to derive a signal independent of the position of the loop may be explained without regard to the frequency of the signal applied to the transmitter loop. Accordingly, to simplify the following explanation, assume for the purpose of the explanation only, the signal applied to the transmitter loop is a constant d.c. potential. Also assume that the position of the transmitting loop is referenced to the phase A conductor. Under such circumstances, when this vehicle is moving the voltage induced between the phase A and phase B conductors will be a cosine function of the angular position of the loop relative to the conductor 54. This may be expressed as:

$$v_{AB} = K \cos a$$

where $K$ = a constant and
$a$ = angular position or distance along the line (1)

Because of the 120° offset of the phase conductors the voltage induced between the conductors of phases B and C may be expressed as follows:

$$V_{BC} = K \cos (a + 120°) \quad 2.$$

Similarly, the voltage induced between the conductors of phases C and A is:

$$V_{CA} = K \cos (a + 240°) \quad 3.$$

In the implementation of the communication system to be described subsequently, means are provided to square and then sum the voltages induced on the phase conductors. The effect of such signal processing is illustrated by the following relationships:

$$v_{AB}^2 + v_{BC}^2 + V_{CA}^2 = K^2 [\cos^2 a + \cos^2 (a + 120°) + \cos^2 (a + 240°)] \quad 4.$$

but by the identity;

$$\cos^2 x = ½ (1 + \cos 2x), \quad 5.$$

equation (4) can be written as:

$$v_{AB}^2 + v_{BC}^2 + v_{CA}^2 = K^2/2 [3 + \cos 2a + \cos 2(a + 60°) + \cos 2 (a + 240°)] \quad 6.$$

but:

$$\cos 2a + \cos 2(a + 120°) + \cos 2 (a + 240°) = 0 \quad 7.$$

and:

$$v_{AB}^2 + v_{BC}^2 + v_{CA}^2 = 3K^2/2 \quad 8.$$

Thus it is seen that the sum of the squared voltages on the conductors of the transmission line is of constant value with respect to the position along the transmission line. Accordingly, regardless of the frequency of the signal induced in the transmission line by the transmitting loop a signal can be derived at the wayside station independent of the position of the loop along the line.

PART III — COUPLING INTO THE END OF THE TRANSMISSION LINE

Since the transmission line is to be used for both transmitting and receiving the wayside station transmitter coupling into the end of the line must be of such character that it will not short out the received signal from the transmitting loop in the vehicle. Accordingly, the end of the line transmitter is coupled into each phase conductor through an impedence high enough to prevent loss of the received signal from the vehicle and a high input impedence receiving circuit is connected between each pair of phase conductors. Such an arrangement would be satisfactory except for the fact that transmission of in-phase currents on each of the phase conductors would result in reflections from the far end of the transmission line. This reflection would be avoided if the currents in the separate phases were 120° phase displaced, which could be provided by phase shift networks. Such phase shift networks, however, would require a wide bandwidth and would be very costly.

Figure 4:
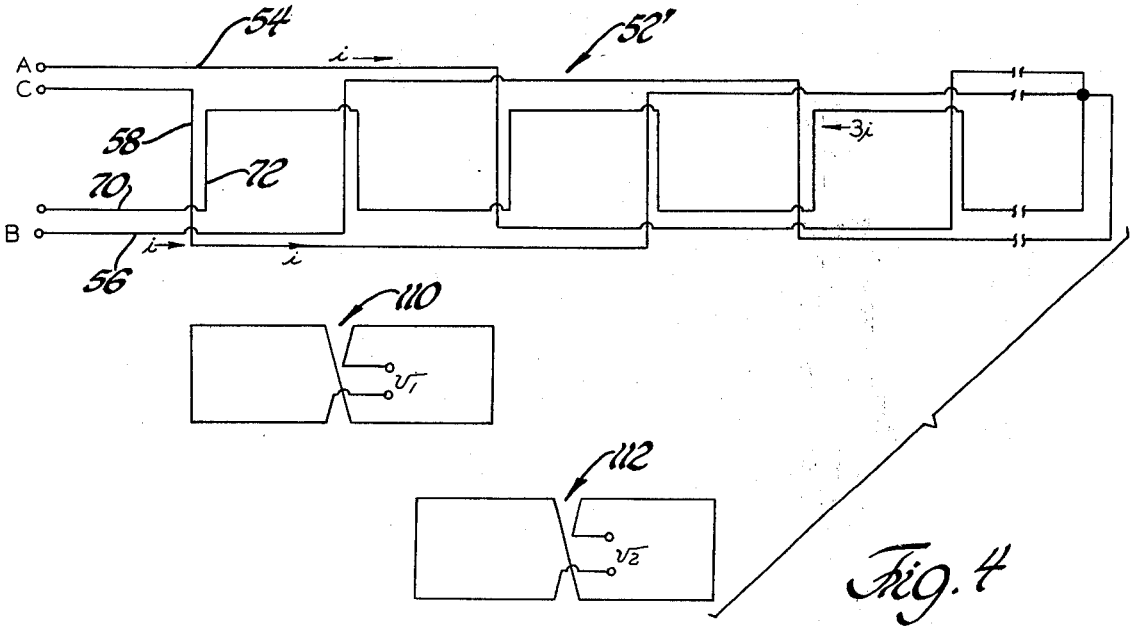
FIG. 4 depicts a three-phase, four-wire transmission line with vehicle receiving loops.

In accordance with the invention this problem of reflections at the end of the transmission line is avoided by the addition of a fourth conductor to the three-phase transmission line. The transmission line 52' as shown in FIG. 4 is such a three-phase, four conductor line and is the same as transmission line 52 of FIG. 2 except for the addition of the return conductor 70. It is noted that the conductor 70 is also formed in a rectangular wave configuration but having a cycle length equal to one third that of the phase conductors so that a crossover 72 occurs at intervals corresponding to 60° on the phase conductors. At the far end of the transmission line each of the phase conductors 54, 56 and 58 is connected directly to the return conductor 70. It will be noted that each of the phase conductors 54, 56 and 58 has transmitted along it from the wayside station a current $i$ and the currents in the phase conductors are in-phase with each other. Consequently the return conductor 70 carries a current $3i$ which is out of phase with the currents in the phase conductors. It will be appreciated that the addition of the return conductor 70 does not change the far field radiation characteristics of the transmission line as discussed in Part II above because of the configuration. Furthermore, the transmission line, with the addition of the return conductor, still permits derivation of a constant signal voltage as a function of transmitter loop position along the transmission line as discussed in Part II with reference to FIG. 2.

The preferred manner of coupling the base station transmitter and receivers into the end of the transmission line is illustrated in FIG. 5. The transmission line of FIG. 5 is a three phase, four wire line as illustrated in FIG. 4 and comprises phase conductors 54, 56 and 58 and a return conductor 70. Coupling with the transmitter into the transmission line is accomplished by a transformer 74. The transformer has a primary winding 76 energized by a power amplifier 78 of the transmitter. The transformer has secondary windings 80, 82 and 84 which are connected respectively across each of the phase conductors 54, 56 and 58 and the return conductor 70. For isolation purposes, resistors 85, 88 and 90 are connected respectively between the phase conductors 54, 56 and 58 and their respective transformer secondaries. The arrangement just described couples the transmitter signal into the transmission line in such manner that the phase conductors carry equal amplitude, in-phase currents.

The base station receiver is coupled into the transmission line by transformers 92, 94 and 96. The transformer 92 has a primary winding connected between the phase conductors 52 and 56 and its secondary winding connected to the amplifier 98. Transformer 94 has its primary winding connected between the phase conductors 56 and 58 and its secondary winding connected to the amplifier 102. Similarly, transformer 96 has its primary winding connected between the phase conductors 54 and 58 and its secondary winding connected to the amplifier 104. The outputs of the amplifiers 98, 102 and 104 may be regarded as phase AB, phase BC and phase CA signals, respectively. These signals are processed further by squaring and summing as discussed above by further circuit implementation which will be described below with reference to FIG. 9.

PART IV — VEHICLE RECEIVER COUPLING WITH TRANSMISSION LINE

In order for the vehicle station receiver to pick up signals from the transmission line, receiving loops 110 and 112 are provided as illustrated in FIG. 4. To prevent the receiving loops 110 and 112 from receiving extraneous signals generated by far field transmitters outside the communication system, each of the loops is of figure-eight configuration. The receiving loop 110 will develop a voltage $v_1$ and receiving loop 112 will develop a voltage $v_2$.

In accordance with the invention the two receiving loops 110 and 112 are positioned 90° apart with respect to the phase conductors in the transmission line. It is observed in FIG. 4 that the crossovers on the phase conductors are spaced at 60°; accordingly, the crossover of receiving loop 112 is offset in the direction of the transmission line from the crossover of receiving loop 110 by a distance equal to one and one half times the crossover spacing of the phase conductors. With this arrangement, assuming the presence of a modulated transmission signal on the transmission line, the voltage induced in the receiving loops 110 and 112 may be considered to be cosine functions of the position of the receiving loops along the transmission line. Accordingly, the voltage induced in each loop will vary in accordance with the position of the respective loop along the transmission line. The system is arranged to utilize these position dependent induced voltages to derive a signal in the vehicle independent of position. As will be apparent, an explanation of how this is accomplished, like the previous similar explanation of how a position independent signal is received from the line in response to voltages induced therein by transmitter loop 50, may be provided without regard to the freguency of the signals received from the line by the loops. To simplify the following explanation, therefore, assume for the purpose of the explanation only that the signal of interest to this explanation applied to the transmission line is a constant d.c. potential. Thus, while the vehicle is moving the voltages induced in loops 110 and 112 because of their 90° offset may be expressed as:

$$v_1 = M \cos a \qquad 9.$$

and $$v_2 = M \cos (a + 90°) \qquad 10.$$

where

M = a constant and $a$ = angular position or distance along the line

In the implementation of the vehicle station receiver to be described subsequently, means are provided to square and then sum the voltages induced in the two receiving loops. The effect of such signal processing will be seen from the following relationship:

$$v_1^2 + v_2^2 = M^2 [\cos^2 a + \cos^2 (a + 90°)] \qquad 11.$$

This can be expressed as:

$$v_1^2 + v_2^2 = M^2/2 [2 + \cos 2a + \cos 2 (a + 90°)] \qquad 12.$$

but:

$$\cos 2a + \cos 2 (a + 90°) = 0 \qquad 13.$$

therefore:

$$v_1^2 + v_2^2 = 2M^2 \quad 14.$$

From the equation (14) it is apparent that the sum of the squares of the voltages in the two receiving loops 110 and 112 is of constant value with respect to position along the transmission line regardless of the frequency of the signal applied to this line.

Figure 6:
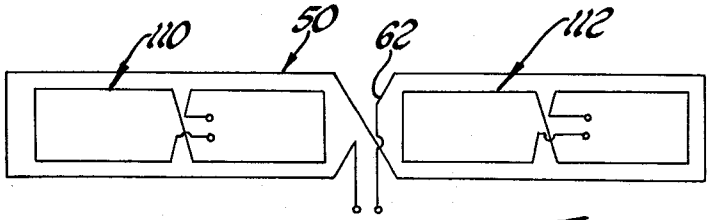
FIG. 6 shows the configuration of the vehicle mounted transmitting and receiving loops.

In order to minimize the coupling between the transmitting loop of the vehicle station transmitter and the receiving loops of the vehicle station receiver the transmitting and receiving loops are disposed relative to each other as shown in FIG. 6. The transmitting loop 50 as described with reference to FIG. 2 is of figure-eight configuration and the two sections or lobes thereof are of equal area separated by the crossover 62. The receiving loop 110 is disposed within the left hand section of the transmitting loop 50 and the receiving loop 112 is disposed within the right hand section of the transmitting loop 50. This arrangement results in both sections of receiving loop 110 coupling into the same phase of the transmitted signal and because of the figure-eight configuration the net coupling is 0. Similarly the receiving loop 110 will have a coupling of approximately 0 with the other phase of the transmitted signal. The receiving loop 112, being disposed inside the right hand section of the transmitting loop 50, will exhibit a similar coupling relation with the transmitting loop.

PART V — TRANSMISSION LINE CONSTRUCTION

Figure 7:
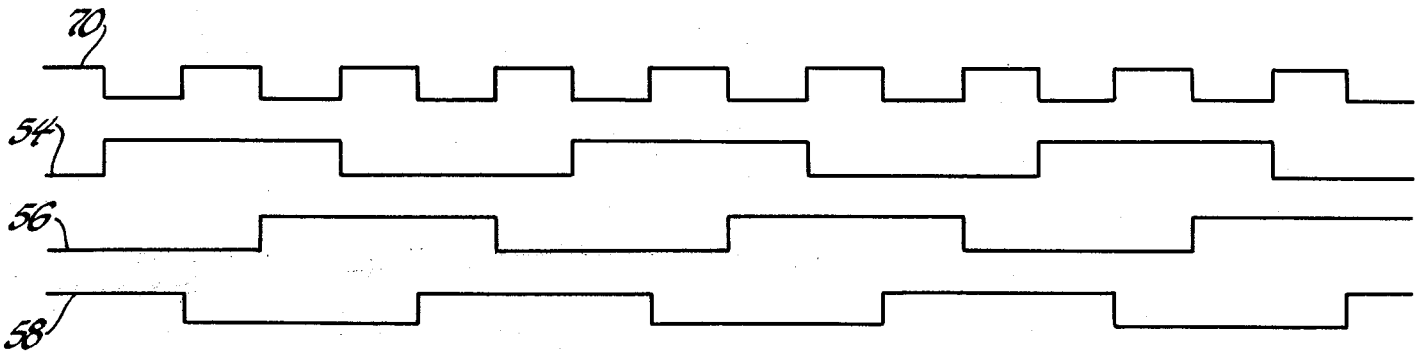
FIG. 7 shows the configuration of the four conductors in the transmission line.

The transmission line of this invention is advantageously constructed in cable form as illustrated in FIGS. 7 and 8. FIG. 7 shows the relationship of the rectangular wave phase windings 54, 56 and 58 with the return conductor 70, it being understood that the conductors overlie each other as described with reference to FIGS. 2 and 4 and further shown in FIG. 8. As shown in FIG. 8 the transmission line is formed as a flat cable with a sandwich construction of ribbon insulators having conductive paths provided thereon. The return conductor 70 is disposed on the upper face of an insulator ribbon 120 and is covered by an insulator ribbon 122 which forms the one outer face of the cable. The phase conductor 58 is disposed on the upper surface of an insulator ribbon 126 which is disposed face to face with the lower surface of the ribbon 120. The phase conductor 56 is disposed on the upper face of an insulator ribbon 128 which in turn is disposed face to face with the lower surface of the ribbon 126. The phase conductor 54 is disposed on the lower face of the insulator ribbon 128 and is covered by an outer insulator ribbon 124 which constitutes the outer face of the transmission line cable. The insulator ribbons are suitably formed of a plastic material such as polyethylene having the desired properties for the transmission line application. The laminated insulated ribbons are bonded together by adhesion or welding to form a unitary body. The conductor strips on the faces of the ribbons may be formed by conventional electro-etching or electro-plating processes to obtain the desired width and thickness of the strips or traces. Alternatively, the conductive strip or trace on the face of the insulator ribbons may be formed by means of a conductive tape having an insulating backing.

It will be appreciated that the specific design of the transmission line will depend upon the particular application in which it is to be used. The pitch of the phase conductors, i.e. the length of a "rectangular wave" cycle will be determined at least in part by the degree of resolution desired in measuring position and speed of the vehicle along the transmission line. With the pitch of the phase conductors established, the spacing of the crossovers in the phase conductors and in the return conductor will be established. The distributed capacitance along the conductors will depend, of course, upon the width of the conductive strip, the dielectric constant of the insulator ribbons and other known factors and should be sufficient so that the environment will have negligible effect upon the characteristic impedence of the line.

PART VI — BASE STATION

FIG. 9 shows a block diagram of the base station or local controller station of the communication system. As mentioned previously the communication system of the illustrative embodiment provides for two-way transmission of safety system information, vehicle operation and control data and voice communication. Such communication is transmitted from the vehicle through the wayside transmission line 36 or 40 (see FIG. 1). Transmission line 36 is used when the vehicle retention arm 18 is extended, which as previously described, positions the inductive loops 44 (including transmitter loop 50) in coupling relation with the transmission line 36. When the retention arm 18 is retracted and the retention arm 20 is extended the coupling loop 46 (including a transmitting loop identical to loop 50) is in coupling relation with the transmission line 40. As shown in FIG. 9, the base station receiver is coupled to the transmission line 36 through conductors 130, 132 and 134 which carry the phase signals A, B and C respectively. It is noted that these signals are derived from the amplifiers 98, 102 and 104 as shown in FIG. 5. The input of the base station receiver is also coupled to the transmission line 40 through the conductors 130′, 132′ and 134′ which carry phase signals A, B and C respectively.

In order to accept the incoming signals from either of the transmission lines the receiver is provided with summing circuits 154, 156 and 158 which correspond with phases A, B and C respectively. The phase A signal is supplied from transmission line 36 through conductor 130 to a bandpass filter 138 and thence through an amplifier 146 to the summing circuit 154. The phase A signal from transmission line 40 is supplied through conductor 130′ to a bandpass filter 144 and thence through an amplifier 152 to the summing circuit 154. The phase B signal from transmission line 36 is applied through conductor 132 directly to the summing circuit 156 and the phase B signal from transmission line 40 is applied through conductor 132′ to the summing circuit 156. Similarly the phase C signal from transmission line 36 is applied through conductor 134 directly to the summing circuit 158 and the phase C signal from transmission line 40 is applied through conductor 134′ to the summing circuit 158.

As discussed above in Part II, the received phase signals are processed by squaring and summing for the purpose of obtaining a continuous signal, i.e. one which is of constant amplitude as a function of position of the transmitting loop along the transmission line. To perform this signal processing the base station receiver includes squaring circuits 157, 159 and 161 and a summing circuit 162. The phase A signal from the summing circuit 154 is applied directly to the squaring circuit 157. The output thereof is applied to the summing circuit 162. The phase B signal is applied from the summing circuit 156 through the bandpass filter 140 and an amplifier 148 to the input of the squaring circuit 159, the output of which is connected to the summing circuit 162. The phase C signal is applied from the output of the summing circuit 158 through a bandpass filter 142 to an amplifier 150 and thence to the input of the squaring circuit 161. The output of the squaring circuit 161 is applied to the input of the summing circuit 162.

The safety system information which includes vehicle position speed direction and retention arm position is derived from the received phase signals prior to the squaring and summing operation. The retention arm position on the vehicle is signified by which of the transmission lines 36 or 40 is transmitting a signal to the receiver. Accordingly, retention arm position, i.e. whether the right hand retention arm 18 is extended or retracted is signified by the presence or absence, respectively, of a signal from transmission line 36. This information is obtained by an arm position indicator suitably in the form of an on-off switching means 164 which is connected to the output of the amplifier 146. When the transmission line 36 is carrying the transmitted signal the output of amplifier 146 will energize the on-off switch 164 to the on condition, thus indicating that the right hand retention arm 18 is in the extended position. When no signal is present on the transmission line 36 the amplifier 146 will not energize the on-off switch 164 which will then assume the off condition and thus indicating the left hand retention arm 20 is extended. The vehicle speed information is derived at the base station receiver by a speed indicator which may take the form of a frequency meter 166 which receives one of the phase signals and, as shown, has its input connected with the output of the amplifier 150. As discussed above, the signal on each of the phase conductors in the transmission line has a frequency corresponding to the speed of movement of the transmitting loop along the transmission line. Accordingly, the frequency measured at the receiver by the frequency meter 166 is directly proportional to vehicle speed.

The direction of vehicle travel is derived by a direction indicator which takes the form of a sequence detector 168 having its input connected to the outputs of the amplifiers 148, 150 and 146. As previously discussed, the phase conductors of the transmission line are energized from the transmitter loop on the vehicle with a phase displacement corresponding to the offset of the rectangular waves or loops in the respective phase conductors. In the three phase system the offset corresponds to 120 electrical degrees and for one direction of travel the phase sequence of the phase signals will be ABC whereas for the opposite direction of travel for the vehicle the phase sequence will be CBA. Thus, a conventional sequence detector is operative to indicate the direction of vehicle travel.

The position of the vehicle along the guideway and hence the transmission line is ascertained at the base station receiver by a position indicator suitably in the form of a resettable counter 170. As discussed above, each phase conductor of the transmission line carries a phase signal which is of alternating character with a complete cycle corresponding to movement along the transmission line through a distance equal to the cycle length or pitch of the rectangular wave of the phase conductor. Accordingly, the vehicle position, measured from a predetermined reference point on the guideway and hence the transmission line, is ascertained by counting the cycles of a phase signal beginning at the reference point. For this purpose the counter 170 has its input connected with the output of the amplifier 150.

The data and voice communications are achieved, as previously noted, by phase modulation and in the illustrative embodiment a coherent system is utilized. The base station receiver, as further shown in FIG. 9, includes a voice channel 172, a data channel 174 and a frequency synthesizer 176 connected with a master oscillator 178. The output of the summing circuit 162, which is a continuous signal, is applied through a bandpass filter 180 to one input of a mixer 182. The output of the bandpass filter 180 is applied to an automatic gain control amplifier 184 which is connected to the AGC inputs of the amplifiers 146, 148, 150 and 152. The master oscillator 178 generates a frequency $f_s$ which is applied to the frequency synthesizer 176. The synthesizer 176 produces multiple CW outputs including an output of frequency $f_n'$ on conductor 184 which is connected to the other input of the mixer 182. Accordingly, the mixer develops an intermediate frequency output which is applied through a bandpass filter 186 to the inputs of the voice channel 172 and the data channel 174. The voice channel includes a synchronous or coherent detector 188 with one input connected to the output of the bandpass filter 186. The synthesizer 176 produces an output signal of frequency $f_v'$ on a conductor 190 which is connected to the other input of the detector 188. The output of the detector 188 is applied through a de-emphasis network 192 to the audio circuitry of the voice channel. The data channel 174 includes a synchronous or coherent detector 194 having one input connected with the output of the bandpass filter 186. The synthesizer 176 produces an output having a frequency $f_o'$ on a conductor 196 which is connected to the other input of the detector 194. The output of the detector 194 produces a baseband data signal for further processing.

The base station also includes transmitter circuitry for transmitting signals over the transmission lines to the vehicle station. As shown in FIG. 9, the master oscillator signal of frequency $f_s$ is applied through a conductor 198 to one input of a summing circuit 200. A transmitter data channel 202 includes a modulator 204. A carrier wave signal is applied through a conductor 206 to one input of the modulator 204 and a baseband data signal is applied through a conductor 208 to the other input of the modulator. The output of the modulator is applied to one input of the summing circuit 200. A transmitter voice channel 210 includes a modulator 212. A carrier wave is applied through a conductor 214 to one input of the modulator 212 and a voice signal is applied through a pre-emphasis network 216 and a conductor 218 to the other input of the modulator 212. The output of the modulator 212 is applied to another input of the summing circuit 200. The output of the summing circuit 200 is applied through a transmitter power amplifier 220 to the transmission line through the coupling circuitry as described with reference to FIG. 5.

PART VII — MOBILE STATION

Figure 10:
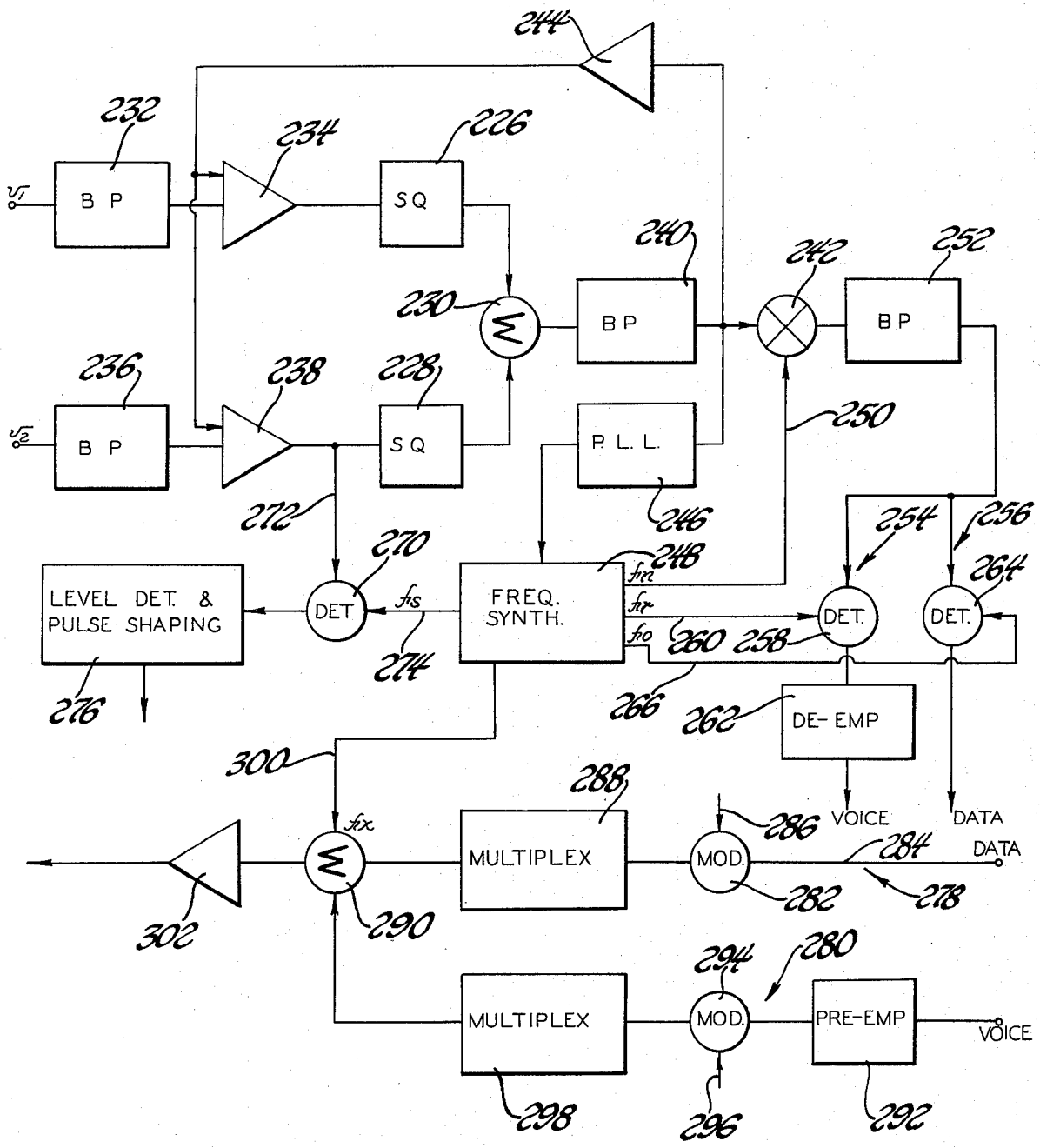
FIG. 10 is a block diagram of the vehicle station.

The vehicle or mobile station of the communication system is illustrated in FIG. 10. The vehicle station comprises a receiver section adapted to receive voice and data signals transmitted over the transmission lines by the base station transmitter. The receiver at the vehicle station is adapted to receive certain safety information such as position and velocity of the vehicle. It is noted that the base station may transmit either selectively on the transmission line which is being used by the vehicle in accordance with the position of its retention arms or the base station may transmit on both of the transmission lines along the guideway.

The input to the receiver section of the vehicle station is taken from the receiver antenna loops 110 and 112 (see FIG. 4) and the signals are denoted as $v_1$ and $v_2$ as shown in FIG. 10. As previously discussed, the receiving loop signals are processed by squaring and summing in order to develop a continuous signal. For this purpose the receiver includes squaring circuits 226 and 228 and a summing circuit 230. The signal $v_1$ is applied through a bandpass filter 232 to the input of an amplifier 234 and thence to the input of the squaring circuit 226. The output of the squaring circuit 226 is applied to one input of the summing circuit 230. In a similar manner, the signal $v_2$ is applied through a bandpass filter 236 to an amplifier 238 and thence to the input of the squaring circuit 228. The output of the squaring circuit 228 is applied to the other input of the summing circuit 230. The continuous signal derived from the summing circuit 230 is applied through a bandpass filter 240 to one input of a mixer 242. The output of the filter 240 is also applied through an automatic gain control amplifier 244 to the AGC inputs of the amplifiers 234 and 238. The output of the filter 240 is also applied to the input of a phase-locked loop 246 and the output thereof is applied to the input of the frequency synthesizer 248. An output signal from the frequency synthesizer, having a frequency $f_n$, is applied through a conductor 250 to the other input of the mixer 242. The intermediate frequency output of the mixer is applied through a bandpass filter 252 to the inputs of a voice channel 254 and a data channel 256. The voice channel 254 includes a phase detector 258 having one input connected with the output of the bandpass filter 252. The other input of the phase detector is supplied with a signal from the frequency synthesizer 248 on a conductor 260. The output of the phase detector is applied through a de-emphasis network 262 to the audio stages of the voice channel. The data channel 256 includes a phase detector 264 having one input connected with the output of the bandpass filter 252. The other input of the detector 264 is supplied with a signal from the frequency synthesizer on the conductor 266. The phase detector output is a baseband data signal adapted for further processing.

The receiver section also includes a safety information channel which comprises a phase detector 270 with a receiving loop signal $v_2$ applied to one input through the bandpass filter 236 and the amplifier 238 through the conductor 272. The other input of the phase detector 270 receives an output signal from the frequency synthesizer 248 on a conductor 274. The output of the phase detector 270 is applied to a level detection and pulse shaping circuit 276. The output of the circuit 276 is applied to vehicle speed and position indicators (not shown).

The vehicle station also includes a transmitter section having a data channel 278 and a voice channel 280. The data channel includes a phase modulator 282 having one input which receives the baseband data signal on a conductor 284 and another input which receives a carrier wave on a conductor 286. The output of the phase modulator is applied through a time multiplexed switch 288 to a summing circuit 290. The voice channel includes a pre-emphasis network 292 which receives the voice signal and which has an output connected with one input of a phase modulator 294. The modulator has another input which receives a carrier signal on a conductor 296. The output of the phase modulator is applied through a multiplexing switch 298 to another input of the summing circuit 290. The summing circuit 290 also accepts a carrier signal from the frequency synthesizer on a conductor 300 and the output of the summing circuit 290 is applied through a transmitter power amplifier to the vehicle transmitter loop 50 as described with reference to FIG. 2.

PART VIII — OPERATION

The operation of the inventive communication system will be described very briefly in view of the operational description given above in conjunction with the description of the communication system. As shown in FIG. 1 the communication system provides two-way transmission between the vehicle 16 and the wayside station 30. With the vehicle traveling on the guideway in the direction indicated by the arrow approaching the junction 14, the retention arm 18 is extended to follow the guide rail 23. Accordingly, the transmit-receive loops 44 are disposed for inductive coupling with the transmission lines 36 and 38 on the right hand side of the guideway. The vehicle station 34 continuously transmits a continuous wave of frequency $f_x$ through the transmit loop 50. This transmission through the three phase, four wire transmission line conveys vehicle speed, position and direction information to the base station which is detected and indicated by the frequency meter 166, resettable counter 170 and the sequence detector 168. Additionally, the transmission of the signal over the transmission line 36 signifies that the right hand retention arm is extended and the arm position is detected by the on-off switching means 64. Voice communication and data transmission from the vehicle to the base station may be accomplished over the transmitter section voice channel 280 and data channel 278 as shown in FIG. 10. Such transmission of voice and data is received at the base station receiver section in the voice channel 172 and data channel 174 as shown in FIG. 9.

Transmission from the base station to the vehicle is accomplished through the transmission lines and coupling of the base station transmitter section to the transmission lines as shown in FIG. 5. The transmitter section of the base station includes a voice channel 210 and the data channel 202 as shown in FIG. 9. The voice and data signal transmissions are received in the vehicle through the receiving loops as shown in FIGS. 4 and 6. The received signals $v_1$ and $v_2$ are applied to the squaring circuits 226 and 228 respectively and thence to the summing circuit 230 as shown in FIG. 10 to produce a continuous signal. The voice and data signals are applied to respective voice channel 254 and data channel 256. Additionally, vehicle position and speed information may be derived at the vehicle station from the transmission by the base station of a continuous wave signal of a frequency $f_s$ from the frequency synthesizer 176 shown in FIG. 9. With this continuous wave signal on the transmission line, the vehicle station receiving loop 112 develops an alternating voltage having a frequency proportional to vehicle speed along the transmission line. This signal at the receiver station is detected in the detector 270 and the output thereof is further processed by frequency measurement and pulse counting to obtain vehicle speed and position information.

As described in detail above, the communication system is operative to transmit vehicle speed, position and direction information and to indicate, at the base station, the retention arm position on the vehicle; additionally, voice and data transmissions are provided. The three phase, four wire transmission line which provides this communication link is substantially immune to far field radiation and the coupling loops are likewise immune to far field radiation. In the receiving sections of both the base station and the vehicle station the received phase signals are squared and then summed to provide a continuous signal, i.e. a signal having an amplitude which is constant as a function of the position of the receiving or transmitting loop along the transmission line.

Although the description of this invention has been given with reference to a particular embodiment, it is not to be construed in a limiting sense. Many variations and modifications of the invention will now occur to those skilled in the art. For a definition of the invention, reference is made to the appended claims.

The embodiments of the invention in which an exclusive property is claimed are defined as follows:

1. A communication system for a vehicle movable along a predetermined path, a transmission line extending along said path and including at least three conductors each conductor having a wave configuration, the cycle length of each wave configuration being the same for all of said conductors, the wave configurations in any one conductor being phase offset along the line from the wave configurations in at least two other of said conductors by a distance equal to said cycle length divided by the number of said conductors, an inductive loop coupled with the transmission line and adapted for movement with the vehicle, means for energizing said inductive loop with a continuous wave signal, whereby signals are induced in said conductors which vary in amplitude as a function of displacement of said vehicle along said path and which are of the same frequency, equal amplitude and phase displaced relative to each other, and receiver means coupled with said line for receiving the signals induced in said line, the received signals being indicative of the speed, direction and position of the vehicle.

2. The invention as defined in claim 1 wherein three conductors have a phase offset equal to ⅓ the cycle length of each wave configuration.

3. The invention as defined in claim 1 wherein said receiver means includes means for measuring frequency of the envelope of the signal induced in one of said conductors as an indication of vehicle speed.

4. The invention as defined in claim 1 wherein said receiver means includes means for counting the cycles of the signal induced in one of said conductors starting from a reference point on the transmission line to obtain an indication of the position of said vehicle.

5. The invention as defined in claim 1 wherein said receiver means includes means for detecting the phase sequence of the signals induced in said conductors.

6. The invention as defined in claim 1 wherein said wave configuration in said conductors is a substantially rectangular wave.

7. The invention as defined in claim 6 wherein each of said conductors includes multiple laterally spaced, staggered straight line segments extending along the transmission line with successive straight line segments being connected by crossover segments extending laterally of the transmission line.

8. The invention as defined in claim 7 wherein the straight line segments of said conductors are disposed in closely adjacent, electrically insulated relationship to provide distributed capacitance in said transmission line.

9. The invention as defined in claim 1 wherein said inductive loop is of figure-eight configuration having two lobes connected by a crossover between the lobes and said lobes having equal areas and extending along the line a distance equal to or somewhat less than the cycle length of the wave configuration of said conductors.

10. A communication system for a vehicle movable along a predetermined path, a transmission line extending along said path and including at least three conductors each having a wave configuration, the cycle length of each wave configuration being the same for all of said conductors, the wave configurations in any one conductor being phase offset along the line from the wave configurations in at least two other of said conductors by a distance equal to said cycle length divided by the number of said conductors, an inductive loop coupled with the transmission line and adapted for movement with the vehicle, means for energizing said inductive loop with a signal to induce equal amplitude, phase displaced signals in said conductors, and receiver means coupled with said conductors including means for squaring the signals in each of said conductors and means for summing the squared signals from the last mentioned means to produce a continuous output signal which has an amplitude independent of the position of said inductive loop along said transmission line.

11. The invention as defined in claim 10 wherein three conductors have a phase offset equal to ⅓ the cycle length of each wave configuration.

12. The invention as defined in claim 10 wherein said wave configuration in said conductors is a substantially rectangular wave.

13. The invention as defined in claim 12 wherein each of said conductors includes multiple laterally spaced, staggered straight line segments extending along the transmission line with successive straight line segments being connected by crossover segments extending laterally of the transmission line.

14. The invention as defined in claim 13 wherein the straight line segments of said conductors are disposed in closely adjacent, electrically insulated relationship to provide distributed capacitance in said transmission line.

15. A communication system for a vehicle movable along a predetermined path and including a mobile station on said vehicle and a base station, a transmission line extending along said path between said vehicle and said base station and including at least three conductors each having a wave configuration, the wave configuration of said conductors being arranged in the transmission line in a pattern like the pattern of the conventional representation of polyphase voltages, each conductor corresponding to each phase voltage in said conventional representation, said base station having a transmitter section coupled to said transmission lines and having a receiver section coupled to said transmission lines, said mobile station including a transmitter section with a transmitting loop inductively coupled to said transmission line, said transmitting loop being of figure-eight configuration and having a length equal to or less than the cycle length of the wave configuration in said conductors, said mobile station including a receiver section having a pair of receiving loops inductively coupled with said transmission line, said receiving loops being displaced from each other in the direction of the transmission line by a distance equal to ¼ the cycle length of said wave configurations.

16. The invention as defined in claim 15 wherein each of said receiver loops is of figure-eight configuration.

17. The invention as defined in claim 16 wherein one of said receiver loops is disposed within one lobe of the figure-eight transmitting loop and the other of said receiving loops is disposed within the other lobe of said transmitting loop.

18. The invention as defined in claim 15 wherein the receiver section of said mobile station includes first squaring means connected with one of said receiving loops and second squaring means connected with the other of said receiving loops and summing means connected with said first and second squaring means to obtain a continuous signal which has an amplitude independent of the position of the receiving loops along the transmission line.

19. A communication transmission line comprising three phase conductors each having a wave configuration, the cycle length of each wave configuration being the same for all of said phase conductors, the wave configuration in any one conductor being phase offset along the direction of the transmission line from the wave configurations in the other two conductors by a distance equal to ⅓ of the cycle length, and a fourth conductor extending the length of the transmission line having a wave configuration with a cycle length equal to ⅓ of the cycle length of said three conductors.

20. The invention as defined in claim 19 wherein said wave configuration in said conductors is a substantially rectangular wave.

21. The invention as defined in claim 20 wherein each of said conductors includes multiple laterally spaced, staggered straight line segments extending along the transmission line with successive straight line segments being connected by crossover segments extending laterally of the transmission line.

22. The invention as defined in claim 21 wherein the straight line segments of said conductors are disposed in closely adjacent, electrically insulated relationship to provide distributed capacitance in said transmission line.

23. The invention as defined in claim 22 wherein each of said conductors is disposed between pairs of insulator ribbons and said ribbons are laminated to form a cable.

* * * * *